United States Patent [19]

Madden et al.

[11] 4,196,823

[45] Apr. 8, 1980

[54] EASY-OPENING CAN END

[75] Inventors: Raymond F. Madden, Llandilo; Dennis B. Moreau, Leumeah, both of Australia

[73] Assignee: Comalco Products Pty. Limited, Victoria, Australia

[21] Appl. No.: 962,791

[22] Filed: Nov. 20, 1978

[30] Foreign Application Priority Data

Nov. 18, 1977 [AU] Australia ..... PD2458
May 31, 1978 [AU] Australia ..... PD4564

[51] Int. Cl.[2] ..... B65D 41/32
[52] U.S. Cl. ..... 220/268; 220/271
[58] Field of Search ..... 220/268, 269, 271; 222/511

[56] References Cited

U.S. PATENT DOCUMENTS 4,105,134 8/1978 DeGendham et al. ..... 220/268
4,134,517 1/1979 Rhades ..... 220/268

FOREIGN PATENT DOCUMENTS 2421314 11/1974 Fed. Rep. of Germany ..... 220/271

*Primary Examiner*—George T. Hall
*Attorney, Agent, or Firm*—Cushman, Darby & Cushman

[57] ABSTRACT

An easy-opening can end having a venting aperture and a dispensing aperture each closed by a respective push-in tab, the relationship between the two apertures and the two tabs being such that, should the venting tab close or not be sufficiently opened after depression, depression of the dispensing tab causes the dispensing tab to contact the venting tab to open the latter and to hold it open.

11 Claims, 8 Drawing Figures

EASY-OPENING CAN END

Figure 1:
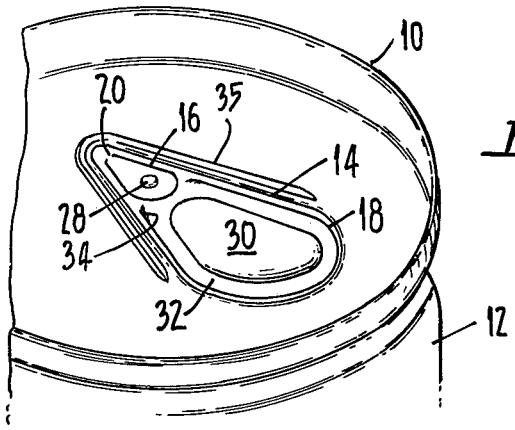

This invention relates to an easy-opening end for a can and in particular to an easy-opening end for a can which contains softdrink or other liquid or solid or semi-solid under pressure, vacuum or any other condition such as for example sterile packing.

Many different types of such ends have been developed in recent years and the general type which is receiving greatest acceptance at present is the type in which there is provided a small push-in tab which can be depressed to vent the can and release the pressure and a second larger push-in tab which can be depressed to permit the contents of the container to be poured out. The small tab, as well as performing the initial venting of the can, allows air to enter the can during pouring to ensure a smooth flow of liquid through the dispensing aperture.

Because of the mechanical limitations of the human finger the venting tab in current practice is provided with a fairly large dome to ensure that the tab will be pushed down sufficiently to act as a vent. This is disadvantageous in that the dome can be accidentally struck and the venting tab opened before the purchaser wishes to dispense the contents of the can.

Some of the solutions to this problem which have already been proposed include the provision of a single aperture large enough to allow it to be used for both dispensing and venting. This has been tried using various aperture shapes but it invariably results in a can end having a sheared aperture extending over a length equal to at least 50% of the diameter of the end. Any piercing of a can end reduces its ability to withstand the internal pressure of the can, and a slot of such large extent reduces the strength of the can end to such a degree that the metal thickness used at present in lightweight cans has insufficient strength. Adding to the metal thickness adds to the cost of the container.

Reducing the height of the dome on the vent tab will reduce the danger of accidental venting but involves the possibility that the vent tab will reclose after finger pressure has been removed, and the vent aperture will not then perform its intended second function of permitting air to enter the can during pouring.

It is an object of this invention to provide an easy-opening can end which will permit a small dome to be used on the vent tab without adverse results. It is a subsidiary object of the invention to provide an easy-opening can end in which, despite arrangement of the vent and pour apertures in close proximity, the strength of the end is not unduly affected.

The invention provides an easy-opening can end having a venting aperture and a dispensing aperture each closed by a respective push-in tab, the relationship between the two apertures and the two tabs being such that, should the venting tab close or not be sufficiently opened after depression, depression of the dispensing tab causes the dispensing tab to contact the venting tab to open the latter and to hold it open.

Preferably the venting aperture and the dispensing aperture are located end-to-end each arranged substantially symmetrically about a common diameter of the can end, each of the tabs being fully sheared around most of its periphery leaving a hinge section at one end, the venting tab extending from its respective hinge towards the dispensing tab a distance such that its free end extends beyond the line about which the dispensing tab will hinge when pressed into the can.

The invention further provides an easy-opening can end having a venting aperture and a dispensing aperture each closed by a respective push-in tab, each of the tabs being fully sheared around substantially the whole of its periphery leaving only a hinge section unpierced, the venting aperture and the dispensing aperture being located end-to-end and each arranged substantially symmetrically about a common diameter of the can end, the free end of the venting tab being arranged closely adjacent the hinged end of the dispensing tab so that the two apertures extend across more than 50% of the said diameter, the hinge section and the material of the dispensing tab adjacent its hinged end forming a bridge across the part of the can end in which the apertures are located and thereby strengthening, or avoiding undue reduction of the strength of, the can end.

Figure 2:
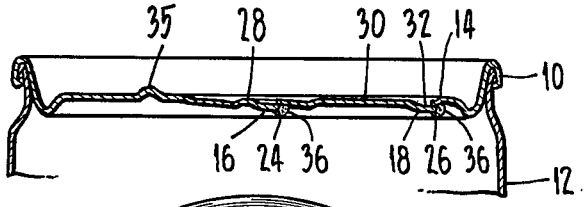
Figure 3:
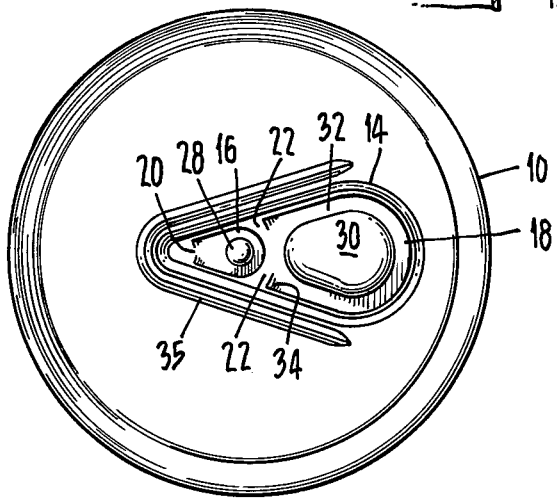
Figure 4:
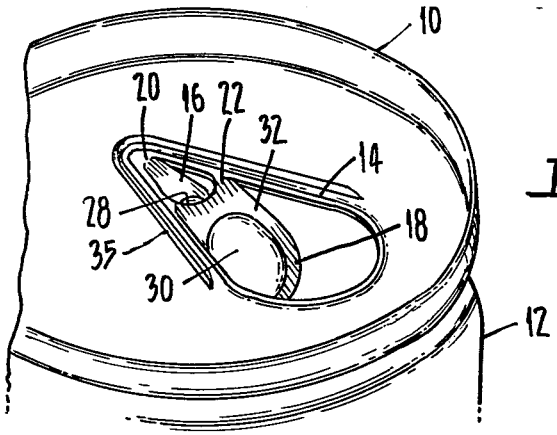
Figure 5:
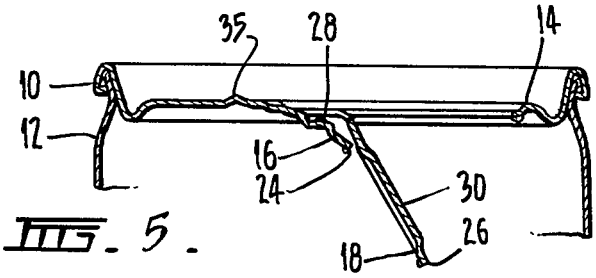
Figure 6:
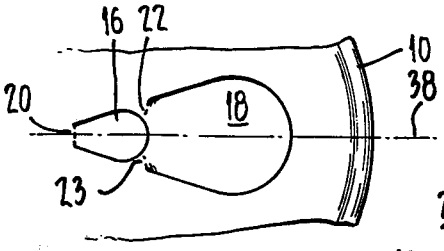
Figure 7:
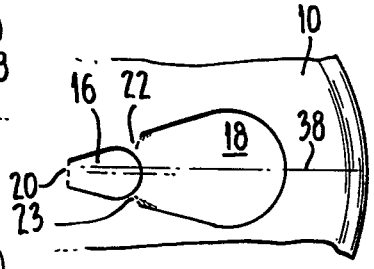
Figure 8:
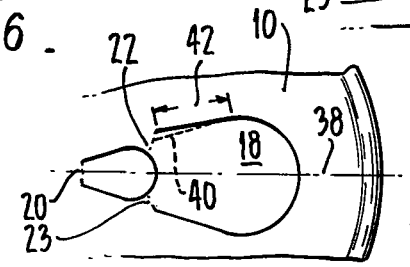

In order that the invention may be more readily understood it will now be described by way of example with reference to a particular embodiment illustrated in the accompanying drawings in which:

FIG. 1 is a perspective view of a can end having an easy-opening arrangement according to the invention, FIG. 2 is a cross-sectional view of the can end of FIG. 1, FIG. 3 is a plan view of the can end of FIG. 1, FIG. 4 is a view similar to FIG. 1 but showing the can end after it has been opened, FIG. 5 is a cross-sectional view of FIG. 4, FIG. 6 is a plan view of part of a can end as illustrated in FIGS. 1 to 5 inclusive but in diagrammatic form to show certain features, and FIGS. 7 and 8 are views similar to FIG. 6 but showing modifications of the tab arrangement illustrated in that Figure.

FIG. 1 shows a can end 10 connected in conventional manner to a can body 12. An area of the can end 10 defined by line 14 is downformed to provide an area in which the venting and dispensing tabs 16 and 18 are located. Both of these tabs are made by piercing and punching in conventional manner so that venting tab 16 remains connected to the can end by a hinge area 20 and dispensing tab 18 remains connected to the can end by a hinge area 22. After the tabs have been pierced, the metal surrounding the apertures is coined to reduce the size of the two apertures. This results in the forward ends 24 and 26 respectively of the tabs 16 and 18 underlapping the can end as shown in FIG. 2 to prevent them being accidentally opened by the pressure within the can.

The tabs 16 and 18 are sealed within the can end by means of a sealant 36 of known acceptable kind applied to the hinge areas 20, 22 and to the pierced sections surrounding the tabs 16 and 18.

A bead 35 which surrounds the hinge areas 20 and 22 of the tabs 16 and 18 is formed by suitably punching the metal of the can end in conventional manner and provides a strengthening of the can end around the dispensing tabs 16 and 18 whereby deformation of the end at and around the dispensing area is prevented.

The tabs 16 and 18 are provided with respective domes 28 and 30 which, as can be seen in FIG. 2, are beneath the general area of the material of the can end in the unopened condition of the end. This very greatly reduces the possibility of accidental opening or venting.

The dome 30 of dispensing tab 18 is surrounded by an area 32 which is depressed below the level of venting tab 16 to provide the shoulders indicated at 34 in FIG. 3. The arrangement of the tabs is such that the hinge area 22 for tab 18 is approximately at the centre of the can end and so that the hinge line passes across the curved forward end 24 of venting tab 16.

To open the can end, venting tab 16 is first depressed a small distance. This releases the pressure in the can and enables dispensing tab 18 to be depressed. As it rotates about its hinge line, tab 18 contacts the outer end 24 of tab 16 and preferably forces it further open. At the least the arrangement is such that tab 18 when depressed contacts the end of the tab 16 to prevent it closing or, if it has already reclosed because it was not depressed to a stage where its hinge was stressed beyond its elastic limit, tab 18 opens it a sufficient distance to enable it to act as an air inlet during dispensing.

The construction described allows the can end to have the venting tab almost flush with the end panel and enables the large tab to be hinged at the centre of the can which is desirable from the point of view of good pouring characteristics. The double hinge formed enables the alignment of the tab to be easily maintained during manufacture and reduces the hinge length to enable depression to be easily achieved.

The metal bridge left at the junction of the small tab and the large tab creates a beam of strength sufficient to maintain the strength of the can end whilst continuing the use of light gauge metal.

In the manufacture of a can end as described above a circular blank is cut from a sheet of flat aluminium alloy and is formed with the groove and ridge around its periphery as shown in the drawings. The blank is then passed through a multi-stage die in which, in succeeding strokes of the die, the following operations are performed.

1. The downforming of the area defined by line 14 is effected and bubbles are raised in the location of the domes 28 and 30.

2. The domes are formed and shearing of the venting and dispensing tabs takes place.

3. Bead 35 is formed.

4. Coining of the metal surrounding the venting and dispensing apertures takes place to cause the tabs to underlap the can end.

5. Lines of sealant are placed around the shear lines of the tabs and across the hinge lines.

It will be understood by those skilled in the art that this series of operations may be varied as necessary to suit any given conditions.

It has been found in practice that, with easy-opening can ends of the type referred to above, if the can is subjected to mechanical damage or to increased pressure resulting from external heating, there is a tendency for the dispensing tab to be blown off the can and projected through the air. This can have dangerous results.

It is therefore a further object of the invention to provide a can end of the type described above in which any unintentional rupturing of the dispensing tab takes place in a controlled manner and complete severance of the tab from the can end is prevented. The basic concept of this aspect of the invention involves the provision of a dispensing tab having a hinge section divided into two spaced apart portions, the tab being more strongly attached to the can end by one of those hinge portions than by the other. This is illustrated in FIGS. 6 to 8 inclusive of the attached drawings.

FIG. 6 illustrates a vent tab 16 and a pour tab 18, each of which is arranged symmetrically on a common centre line 38. Vent tab 16 can be opened by depressing into the can to cause it to rotate about hinge line 20 and pour tab 18 is opened by depressing it to cause it to rotate about hinge lines 22 and 23.

In the construction described in FIGS. 1 to 5 and diagrammatically illustrated in FIG. 6 the lengths of hinge lines 22 and 23 are equal to each other, with the result that excess pressure within the can causes equal stress on the two hinge lines and, if the stress is sufficient to fracture the connection of the tab to the can end, the material tends to tear along both hinge lines simultaneously, thereby projecting the tab away from the can. As noted above this can in some circumstances be very dangerous involving the risk of injury to persons or damage to property.

In FIG. 7 the vent tab 16 and pour tab 18 are illustrated as being offset relative to each other to one side or other of centre line 38. This results in a hinge line 22 having a length somewhat greater than the length of hinge line 23. Since the pressure applied to pour tab 18 is constant throughout its area and therefore symmetrical and since the material for resisting fracture is arranged asymmetrically, any excess pressure within the can will cause the material to tear along hinge line 23, relieving the pressure within the can and leaving hinge line 22 intact. The tab will therefore be retained on the can and the dangerous consequences of failure referred to above will not exist.

In the present form of the invention the offset between the two tabs is such that the length of hinge line 23 is approximately 75% of the length of hinge line 20.

In the form of the invention illustrated in FIG. 8 tab 18 is made asymmetrical about centre line 38 by altering the position of length 42 of the cutting or punching line which defines pour tab 18. The outline of the tab then follows the path shown in full instead of the path of FIG. 6 which is shown as dotted line 40 in FIG. 8. This again has the effect of making hinge line 22 longer than hinge line 23 so that failure of the can end along hinge line 23 will relieve the pressure within the can and prevent the tab becoming fully detached from the can end.

In a further form of the invention (not illustrated) the shear line which defines tab 18 is terminated, adjacent hinge line 22, short of the position illustrated in FIG. 6. This again has the effect of making hinge line 22 longer than hinge line 23.

We claim:

1. An easy-opening can end having a venting aperture and a dispensing aperture each closed by a respective push-in tab, each of the tabs being fully sheared around substantially the whole of its periphery leaving only a hinge section unpierced, the venting aperture and the dispensing aperture being located end-to-end and each arranged substantially symmetrically about a common diameter of the can end, the free end of the venting tab being arranged closely adjacent the hinged end of the dispensing tab so that the two apertures extend across more than 50% of the said diameter, the hinge section and the material of the dispensing tab adjacent its hinged end forming a bridge across the part of the can end in which the apertures are located and thereby strengthening, or avoiding undue reduction of the strength of, the can end.

2. An easy-opening can end having a venting aperture and a dispensing aperture each closed by a respective push-in tab; the venting aperture and the dispensing aperture being located end-to-end, each arranged substantially symmetrically about a common diameter of the can end; each of the tabs being fully sheared around most of its periphery leaving a hinge section at one end; the venting tab extending from its respective hinge towards the dispensing tab a distance such that its free end extends beyond the line about which the dispensing tab will hinge when pressed into the can so that, should the venting tab close or not be sufficiently opened after depression, depression of the dispensing tab causes the dispensing tab to contact the venting tab to open the latter and to hold it open.

3. An easy-opening can end having a venting aperture and a dispensing aperture each closed by a respective push-in tab; the venting tab and the dispensing tab being aligned with each other and each attached to the can end by means of respective hinge sections and each of the tabs extends in the same direction from its hinge section, the arrangement being such that the free end of the venting tab extends into the hinge section of the dispensing tab so that should the venting tab close or not be sufficiently opened after depression, depression of the dispensing tab causes the dispensing tab to contact the venting tab to open the latter and to hold it open.

4. An easy-opening can end having a venting aperture and a dispensing aperture each closed by a respective push-in tab; the venting tab and the dispensing tab being fully sheared from the can end with the exception of respective hinge sections by means of which they remain attached to the can end to define hinge lines about which the respective tabs will rotate when depressed into the can, the two hinge lines being substantially parallel to each other and spaced from each other, there being a degree of overlap between the venting tab and the dispensing tab such that depressing the dispensing tab into the can causes its under surface to engage with the venting tab so that should the venting tab close or not be sufficiently opened after depression, depression of the dispensing tab causes the dispensing tab to contact the venting tab to open the latter and to hold it open.

5. An easy-opening can end as claimed in claim 2, claim 3 or claim 4 including a dome formed on the venting tab for engagement by the finger of the user, the height of the dome and the dimensions of the venting aperture being such that the pressure of an average finger on the dome does not depress the venting tab a sufficient distance to cause permanent deformation of the hinge by means of which the venting tab is attached to the can end.

6. An easy-opening can end as claimed in claim 5 wherein the venting aperture and the dispensing aperture are arranged in a portion of the can end which has been downformed during manufacture characterized in that the dome of the said tab is recessed below the general surface of the can end.

7. An easy-opening can end as claimed in claim 2, claim 3 or claim 4 wherein the hinge section for the dispensing tab is divided into two portions by the free end of the venting tab, characterized in that one of said hinge portions is deliberately made stronger than the other.

8. An easy-opening can end as claimed in claim 7 wherein the venting tab and the dispensing tab are arranged substantially in alignment one with the other but in which the axis of symmetry of one is offset from the axis of symmetry of the other.

9. An easy-opening can end as claimed in claim 7 wherein the dispensing tab is made slightly asymmetrical in that the shear line by which it is defined ends further from one side of the shear line defining the venting tab on one side of the venting tab than on the other side of the venting tab.

10. An easy-opening can end as claimed in claim 7 wherein both the venting tab and the dispensing tab are defined by substantially U-shaped shear lines with the arms of the U approaching each other adjacent the hinge section, characterized in that the two tabs have a common axis of symmetry with the exception that the arm of the U defining one side of the dispensing tab forms a smaller angle with the axis of symmetry than does the other arm of the U, thereby giving a broader hinge portion on one side than on the other.

11. An easy-opening can end as claimed in claim 7 wherein both the venting tab and the dispensing tab are defined by substantially U-shaped shear lines with the arms of the U approaching each other adjacent the hinge section, characterized in that the arm of the U defining one side of the dispensing tab is shorter than the arm defining the other side of the dispensing tab, thereby giving a broader hinge portion on one side of the dispensing tab than on the other.

* * * * *